United States Patent [19]

Doyle

[11] Patent Number: 4,968,379

[45] Date of Patent: Nov. 6, 1990

[54] APPARATUS FOR UNIFORMLY WETTING A CURVILINEAR SURFACE

[75] Inventor: Mark C. Doyle, San Diego, Calif.

[73] Assignee: Pacific Device, Inc., San Diego, Calif.

[21] Appl. No.: 199,072

[22] Filed: May 25, 1988

[51] Int. Cl.[5] ..... B05C 1/00

[52] U.S. Cl. ..... 156/578; 15/104.04; 15/104.05; 134/22.11; 134/22.14; 134/166 C; 118/214; 118/215; 118/266; 118/268; 118/693; 118/254; 222/61; 427/230; 156/295; 156/308.6

[58] Field of Search ..... 134/22.11, 22.14, 166 C; 15/104.04, 104.03, 104.05; 118/254, 214, 215, 268, 266, 693, 694, 264; 156/295, 308.6, 578; 222/61; 427/230

[56] References Cited

U.S. PATENT DOCUMENTS

| | | | |
|---|---|---|---|
| 2,083,965 | 6/1937 | Schulz | 222/61 |
| 2,764,958 | 10/1956 | Stahl | 118/268 |
| 2,875,020 | 2/1959 | Ring . | |
| 3,003,461 | 10/1961 | Rosenthal | 118/266 |
| 3,017,853 | 1/1962 | Hunt . | |
| 3,133,309 | 5/1964 | Miles . | |
| 3,188,674 | 6/1965 | Hobbs . | |
| 3,335,700 | 8/1967 | DiLrado et al. . | |
| 3,527,611 | 9/1970 | Newfarmer . | |
| 3,765,983 | 10/1973 | Putzier | 15/104.03 X |
| 4,130,909 | 12/1978 | Greene | 118/268 X |
| 4,237,641 | 12/1980 | Gupton . | |
| 4,276,718 | 7/1981 | Keeton et al. . | |
| 4,403,363 | 9/1983 | Hess | 15/104.04 |
| 4,554,696 | 11/1985 | Nye, Jr. . | |
| 4,759,175 | 7/1988 | Inoue | 118/264 X |

*Primary Examiner*—Michael W. Ball
*Assistant Examiner*—Jeff H. Aftergut
*Attorney, Agent, or Firm*—Fulwider, Patton, Lee & Utecht

[57] ABSTRACT

Apparatus for uniformly wetting a curvilinear surface of a length of tubing with solvent or other liquid. A wetting element such as a block of porous material has a curvilinear portion with a shape complemental to the shape of the surface to be wetted. The liquid is supplied to the wetting element by capillary action through a porous block or a sponge and passes into and through the wetting element, wetting the curvilinear portion. When the tubing to be wetted is brought into close contact with the curvilinear protein, the liquid is transferred to the tubing, forming a uniform coating on the surface thereof. Compressed air may be applied to the liquid through a pulse valve to urge the liquid into the wetting element as needed to re-wet the wetting element.

14 Claims, 3 Drawing Sheets

APPARATUS FOR UNIFORMLY WETTING A CURVILINEAR SURFACE

BACKGROUND OF THE INVENTION

This invention relates generally to apparatus for uniformly wetting a curvilinear surface of a length of tubing with a liquid such as a solvent.

Plastic tubing is used in many kinds of apparatus such as medical devices to conduct fluids from point to point. Extremities of such tubing must be connected to couplings or the like, and frequently a preferred method of connecting the tubing to the coupling is by means of a liquid solvent which bonds the two together. In some instances the tubing fits into an opening in the coupling, and in such a case the solvent must be applied to the exterior of the tubing before inserting it into the coupling. In other instances the coupling fits into the hollow interior of the tubing, in which case the solvent must be applied to the interior of the tubing before inserting the coupling into the tubing.

In order to achieve a mechanically strong, leakproof connection between the tubing and the coupling, the solvent must be uniformly applied to the portion of the tubing which is to be bonded to the coupling. However, a consistently uniform application of solvent to lengths of tubing has been difficult to achieve, especially in a production line environment. The solvent is typically applied to the tubing by hand, a relatively time-consuming procedure which sometimes results in an irregular or spotty coating of solvent on the tubing, and such an irregular coating in turn leads to poor bonding and a weak, leaky connection between the tubing and the coupling.

Accordingly there is a need for a way to uniformly wet a curvilinear surface of a length of tubing with a liquid such as a solvent, especially in a production line environment.

SUMMARY OF THE INVENTION

The present invention provides apparatus for uniformly wetting a curvilinear surface of a length of tubing with a liquid such as a solvent. The apparatus is adapted for use in a relatively high-speed production line environment and in such an environment consistently applies a uniform coating of solvent to the surface of the tubing to facilitate the formation of a mechanically strong, leakproof connection between the tubing and a coupling.

Briefly and in general terms, apparatus according to the invention comprises a wetting element including a curvilinear portion having a shape complemental to the shape of the surface to be wetted, said portion being sufficiently rigid to substantially retain its shape when placed into close-fitting contact with the surface to be wetted, and means to supply a liquid to the wetting element for passage of the liquid into and through the element to wet said curvilinear portion whereby when the surface to be wetted is placed into close-fitting contact with said curvilinear portion the liquid is transferred onto said surface, wetting the same substantially uniformly.

In a configuration adapted for wetting an exterior surface of the tubing, the curvilinear portion of the wetting element comprises an interior surface of an opening into the element, the opening being sized to receive the portion of the tubing to be wetted in close-fitting relationship. In a configuration adapted for wetting an interior surface of the tubing, the curvilinear portion of the wetting element comprises an exterior surface of a protuberance from the element, the protuberance being sized to fit into the portion of the tubing to be wetted in close-fitting relationship.

The liquid supply means preferably includes a vessel to hold the liquid, means to mount the wetting element to the vessel in spaced-apart relation to the liquid, and porous means such as a sponge or a block of porous material extending between the liquid and the wetting element and having a first extremity immersed in the liquid and a second extremity in close contact with the element and operative to carry the liquid by capillary action to the element.

Optionally, means such as a weight are provided to retain the vessel in a fixed location on a work surface by friction.

A preferred embodiment includes means to apply pressure to the liquid to urge the liquid into the porous means and thence to the wetting element. Such means, which are advantageously utilized in a production line environment to enable an operator to force additional liquid into the block as needed, includes, for example, a pulse valve, means to provide compressed air to the pulse valve, and means to carry the compressed air from the pulse valve into the container.

The wetting element comprises, for example, a block of material such as porous polyethylene or a perforated rigid shell.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 9:
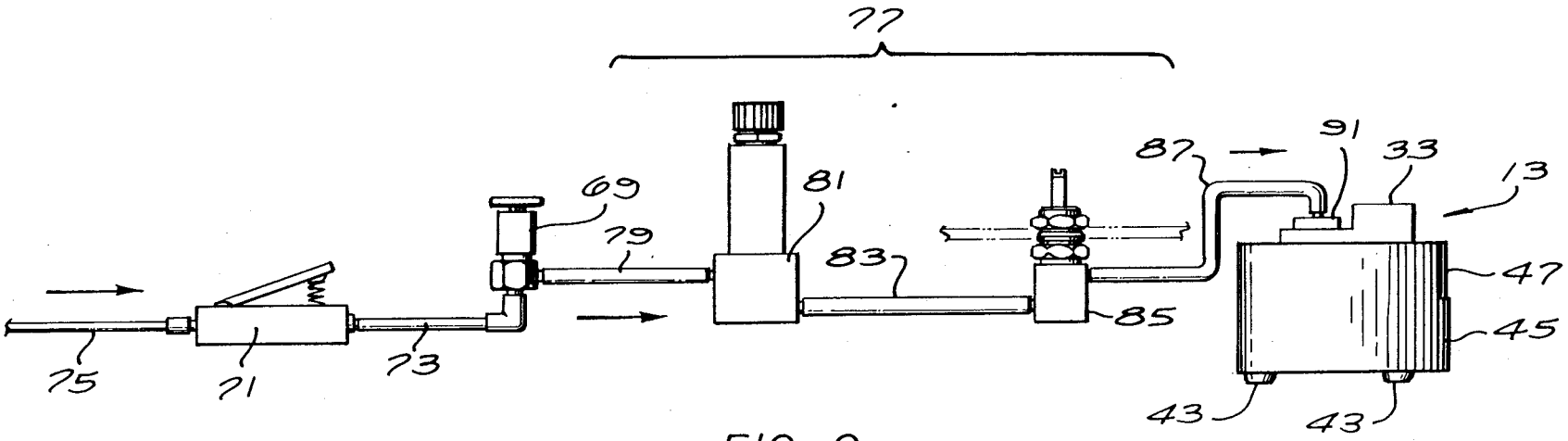
FIG. 9 is a side plan view of the apparatus shown in FIG. 1 and also including means to apply compressed air to force the liquid into the porous material.
Figure 2:
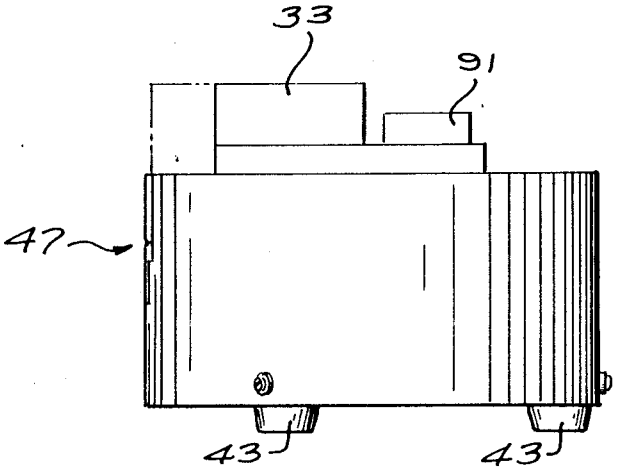
FIG. 2 is a side plan view of the apparatus shown in FIG. 1.
Figure 1:
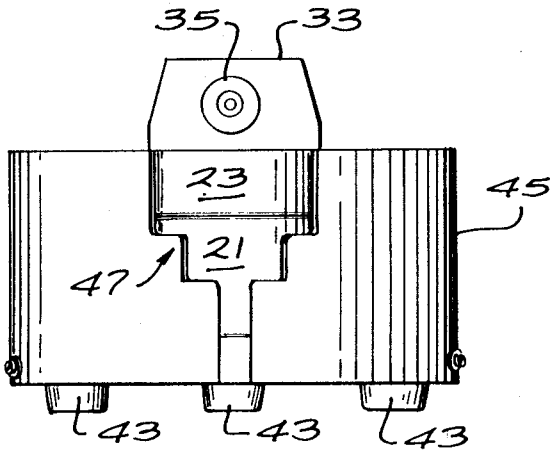
FIG. 1 is a front plan view of apparatus according to the invention.
Figure 3:
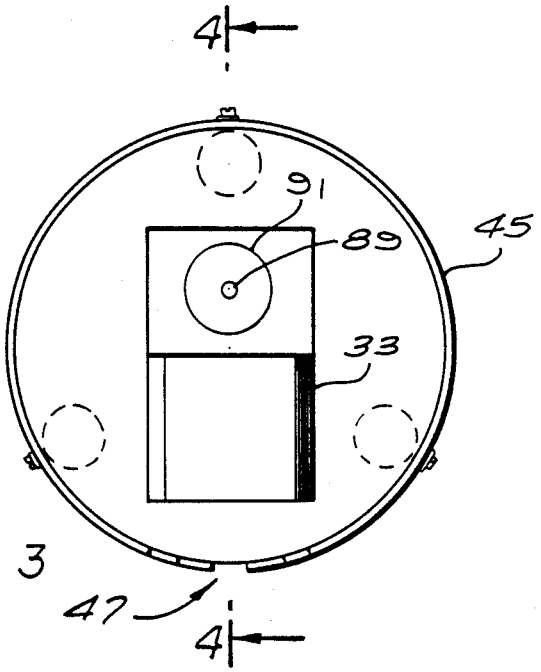
FIG. 3 is a top plan view of the apparatus shown in FIG. 1.
Figure 4:
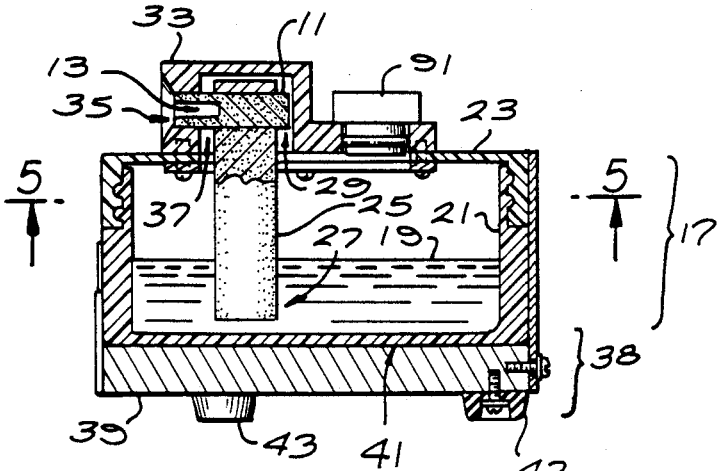
FIG. 4 is a section view taken along the line 4—4 of FIG. 3.
Figure 5:
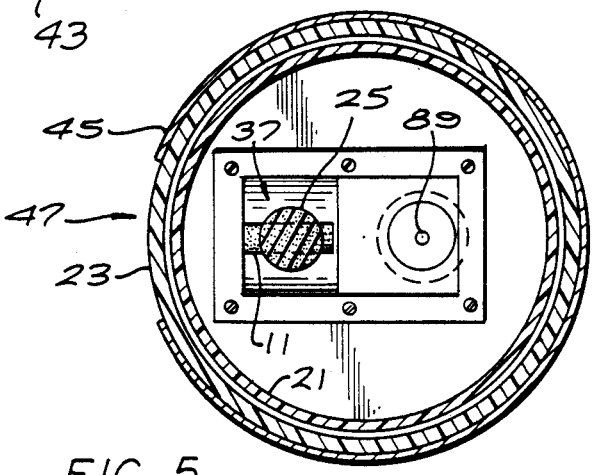
FIG. 5 is a section view taken along the line 5—5 of FIG. 4.

As shown in the drawings for purposes of illustration, the invention is embodied in a novel apparatus for uniformly wetting a curvilinear surface of a length of tubing. The invention is used, for example, to wet the tubing with a solvent so that the tubing can be cemented to a coupling or the like. Application of such a solvent to a length of tubing has been done manually, but manual application of the solvent sometimes results in nonuniform or spotty solvent coverage and this in turn can cause leaky, mechanically weak connections.

The apparatus of the invention, which utilizes a wetting element including a portion having a shape complemental to the shape of the surface to be wetted, consistently provides uniform wetting of the tubing, especially when used in a production line environment, and thereby assures strong, leakproof connections between the tubing and the coupling.

In a preferred embodiment, as shown in FIGS. 1 through 5, apparatus according to the invention comprises a wetting element 11 including a curvilinear portion 13 having a shape complemental to the shape of the surface 15 to be wetted, said portion 13 being sufficiently rigid to substantially retain its shape when placed into close-fitting contact with the surface 15, and liquid supply means 17 to supply a liquid 19 to the element 11 for passage of the liquid 19 into and through the element 11 to wet said curvilinear portion 13 whereby when the surface 15 to be wetted is placed into close-fitting contact with said curvilinear portion 13 the liquid 19 is transferred onto said surface 15, wetting the same substantially uniformly.

The liquid supply means 17 preferably comprises a vessel 21 to hold the liquid 19, mounting means such as a lid 23 on the vessel 21 to mount the wetting element 11 to the vessel 21 in spaced-apart relation to the liquid 19, and porous means 25 extending between the liquid 19 and the block 11 and having a first extremity 27 immersed in the liquid 19 and a second extremity 29 in close contact with the element 11 and operative to carry the liquid 19 to the element 11, for example by capillary action.

In the embodiment shown, the porous means 25 comprises a block of porous material such as polyethylene, the second extremity 29 thereof having a cavity 31 to receive the wetting element 11 in close-fitting relationship to facilitate passage of the liquid 19 from the porous means 25 to the element 11.

In an alternative embodiment (not shown) the porous means 25 comprises a sponge, the second extremity 29 thereof being draped over the wetting element 11 to facilitate passage of the liquid 19 from the porous means 25 to the element 11.

The wetting element 11 is preferably secured to the lid 23 by means of a holder 33 which encloses the element 11 on an upper surface of the lid 23 to minimize contact between the element 11 and the outside atmosphere and thereby to minimize any evaporation of the liquid 19 from the element 11. The holder 33 has an opening 35 adjacent the curvilinear portion 13 of the element 11 to admit the tubing 37 for contacting said portion 13 of the element 11. The porous means 25 extends from the liquid 19 beneath the lid 23 up through an opening 37 in the lid 23 to carry the liquid 19 to the element 11.

Preferably retaining means 38 such as a weight 39 connected to a lower exterior surface 41 of the vessel 21 retains the vessel 21 in a fixed location on a work surface (not shown) by frictional engagement between, for example, a plurality of feet 43 connected to the weight 39 and the work surface.

The vessel 21 is preferably fabricated from transparent or translucent material such as a plastic which does not react chemically with the liquid 19. A metal sheath 45 surrounds the vessel 21 for mechanical protection, and an opening 47 through the sheath 45 permits a visual determination of the amount of liquid 19 remaining in the vessel 21.

Figure 6:
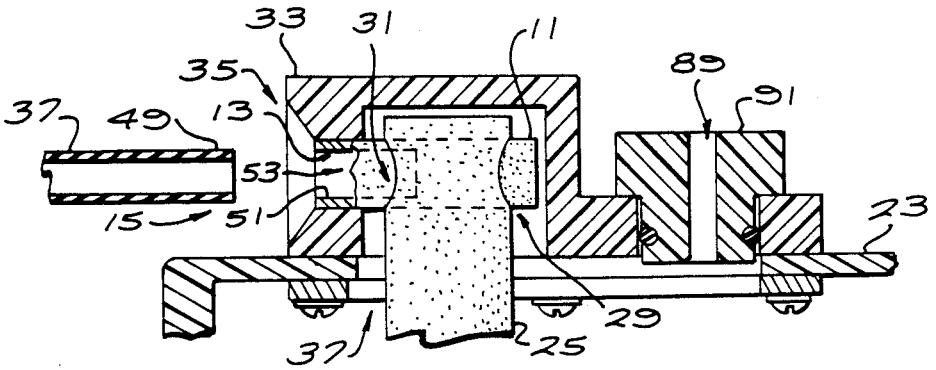
FIG. 6 is a close-up view of the upper portion of the apparatus as shown in FIG. 4 and including a length of tubing positioned for insertion into the apparatus for wetting of the exterior of the tubing.

In a first configuration as shown in detail in FIG. 6, the surface 15 to be wetted comprises an exterior surface 49 of a portion of the tubing 37 and the curvilinear portion 13 of the wetting element 11 comprises an interior surface 51 of a cavity 53 in the element 11, the cavity 53 being sized to receive the portion of the tubing 37 to be wetted in close-fitting relationship.

The wetting element 11 comprises, for example, a block of porous polyethylene or the like. The cavity 53 can be formed in such material by drilling a hole in a rod of porous polyethylene.

Figure 7:
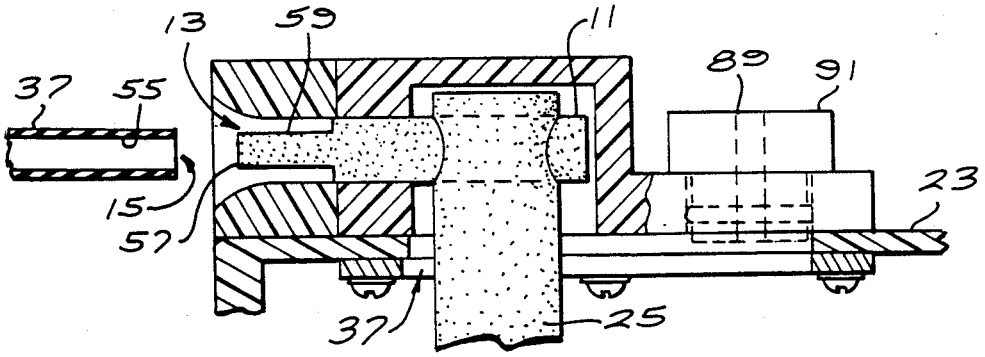
FIG. 7 is a close-up view of another configuration which is similar to the configuration shown in FIG. 6 except that the apparatus is configured for wetting of the interior of the tubing.

In a second configuration as shown in detail in FIG. 7, the surface 15 to be wetted comprises an interior surface 55 of a portion of the tubing 37 and the curvilinear portion 13 of the wetting element 11 comprises an exterior surface 57 of a protuberance 59 from the element 11, the protuberance 59 being sized to fit into the portion of the tubing 37 to be wetted in close-fitting relationship. Such a wetting element can be fabricated by cutting an extremity of a porous polyethylene rod with a sharpened steel tube of appropriate inside diameter to form a protuberance, and then trimming away the unnecessary resulting sleeve of polyethylene.

Figure 8:
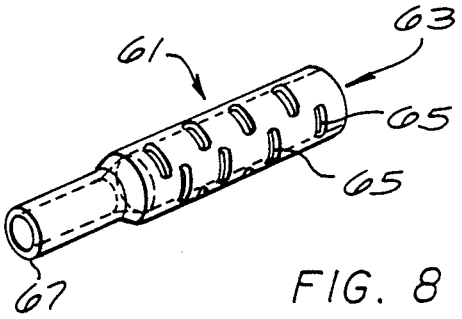
FIG. 8 is a perspective view of a rigid shell for use as a wetting element in an alternate embodiment of the apparatus shown in FIG. 1.

In an alternate embodiment, the wetting element 11 comprises a perforated rigid shell 61 as shown in FIG. 8. The shell is fabricated from a length of heat-shrink tubing or the like. The heat-shrink tubing is shrunk over a suitable form to the desired size to define therein a cavity 63 to receive the tubing 37 in close-fitting relationship. The liquid 19 passes into the heat-shrink tubing 61 through a plurality of perforations 65 therein to wet the tubing 37 inside. An extremity 67 of the heat-shrink tubing opposite the cavity 63 is shrunk to a diameter smaller than that of the tubing 37 to prevent the tubing 37 from being inserted further than is desired into the cavity 63.

In an embodiment particularly adapted for use in a production line environment, in which it is required to sequentially wet a plurality of lengths of tubing in rapid succession, pressure means are provided to apply pressure to the liquid 19 to urge the liquid 19 into the porous means such as the second block 25 and thence to the block 11 so as to rapidly re-wet the block 11 as often as desired, as shown in FIG. 9. The pressure means preferably comprises a pulse valve 69, means such as a pneumatic foot switch 71 connected to the valve 69 through a conductor 73 and to a compressed air source (not shown) through a conductor 75 to provide compressed air to the valve 69, and means 77 to carry the compressed air from the valve 69 into the vessel 21 to apply pressure to the liquid 19.

The means 77 comprises, for example, a conductor 79 to carry the compressed air from the valve 69 to a pressure regulator 81, a conductor 83 to carry the air from the regulator 81 to a flow control valve 85, and a conductor 87 to carry the air from the valve 85 to the vessel 21. The air is admitted into the vessel 21 through an opening 89 which extends through a plug 91 in the lid 23.

The pulse valve 69 comprises, for example, a model PV-1 Clippard Minimatic pulse valve that provides a compressed air pulse having a duration of about 100 milliseconds, a duration which has been found to be satisfactory for urging enough of the liquid 19 through the porous means 24 and into the block 11 to re-wet the curvilinear portion 13. The regulator 81 comprises a Clippard model R-900, R-901 or the like, and the flow control valve 85 comprises a Clippard model MNV-2 needle valve or the like.

In operation, the liquid 19 flows by capillary action through the porous means 25 to the wetting element 11, flowing through the element 11 and wetting the surface of the curvilinear portion 13 thereof. An operator brings a length of tubing into close-fitting contact with the portion 13, applying a uniform coating of liquid to the portion of the tubing which is to be wetted. As soon thereafter as desired, the operator brings another length of tubing into contact with the portion 13 and repeats the process. If pressure means are provided and if the liquid does not flow rapidly enough through the porous means 25 to keep the portion 13 of the wetting element 11 sufficiently wet, the operator engages the foot switch 71. Engaging the switch 71 applies compressed air to the pulse valve 69 which in turn passes a brief pulse of compressed air through the pressure regulator 81 and the flow control valve 85 and into the vessel 21 through the opening 89. This pulse of compressed air urges some of the liquid 19 into the porous means 25 to re-wet the wetting element 11.

From the foregoing it will be appreciated that the invention provides apparatus for uniformly wetting a curvilinear surface of a length of tubing with a solvent or other liquid. The apparatus is configured to wet either an exterior surface or an interior surface of the tubing. The apparatus is simple to use and is adapted for a production line environment to sequentially wet a plurality of lengths of tubing, assuring that each length of tubing is uniformly wetted for cementing to a coupling or the like to form therebetween a mechanically strong, leakproof connection.

Although certain specific embodiments of the invention have been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

I claim:

1. Apparatus for uniformly wetting a curvilinear surface of a length of tubing comprising:

a wetting element including a curvilinear portion having a shape comparable to the shape of the surface to be wetted, said portion being sufficiently rigid to substantially retain its shape when placed into close-fitting contact with the surface to be wetted;

means for holding a liquid to be applied to the tubing;

means for transferring the liquid to the wetting element, said transferring means having a first extremity immersed in the liquid and a second extremity above the liquid and having an opening defined therein, said wetting element being adapted to fit within said opening in close-fitting relationship to facilitate passage of the liquid from said transfer means to said wetting element.

2. Apparatus according to claim 1 wherein said wetting element has an outer surface and said transferring means is adapted to surround and contact a substantial portion of said outer surface.

3. Apparatus for uniformly wetting curvilinear surface of a length of tubing, the apparatus comprising:

a porous wetting element including a curvilinear portion having a shape complemental to the shape of the surface to be wetted, said portion being sufficiently rigid to substantially retain its shape when placed into close-fitting contact with the surface to be wetted; and liquid supply means operative to supply a liquid to the wetting element for passage of the liquid into and through the element to wet said curvilinear portion whereby when the surface to be wetted is placed into close-fitting contact with said curvilinear portion the liquid is transferred onto said surface, wetting the same substantially uniformly, wherein the wetting element comprises a perforated rigid shell made from a heat-shrinkable tube having a plurality of openings defined therein.

4. Apparatus according to claim 3 wherein said heat-shrink tube includes means for preventing the length of tubing to be wetted from being inserted past a desired position in said heat-shrink tube.

5. Apparatus for uniformly wetting a curvilinear surface of a length of tubing, the apparatus comprising:

a porous wetting element including a curvilinear portion having a shape complemental to the shape of the surface to be wetted, said portion being sufficiently rigid to substantially retain its shape when placed into close-fitting contact with the surface to be wetted;

liquid supply means operative to supply a liquid to the wetting element for passage of the liquid into and through the element to wet said curvilinear portion whereby when the surface to be wetted is placed into close-fitting contact with said curvilinear portion the liquid is transferred onto said surface, wetting the same substantially uniformly, said liquid supply means including:

a vessel to hold the liquid;

means for transferring the liquid to said wetting element, said transferring means being partially immersed in the liquid and in direct contact with said wetting element and operative to carry the liquid to the wetting element; and means operatively associated with said liquid supply means for applying pressure within said vessel including means for applying a pulse of compressed air within said vessel for urging an amount of the liquid through said transferring means and onto outer said porous wetting element.

6. Apparatus according to claim 5 wherein the surface to be wetted comprises an exterior surface of a portion of the tubing and wherein the curvilinear portion of the wetting element comprises an interior surface of an opening into the element, the opening being sized to receive the portion of the tubing to be wetted in close-fitting relationship.

7. Apparatus according to claim 5 wherein the surface to be wetted comprises an interior surface of a portion of the tubing and wherein the curvilinear portion of the wetting element comprises an exterior surface of a protuberance from the element, the protuberance being sized to fit into the portion of the tubing to be wetted in close-fitting relationship.

8. Apparatus according to claim 5 wherein said transferring means is adapted to contact and surround a substantial portion of said wetting element to facilitate transfer of liquid to said wetting element.

9. Apparatus according to claim 8 wherein said transferring means has an opening defined therein for receiving said wetting element in a close-fitting relationship to facilitate passage of liquid from said transferring means to said wetting element.

10. Apparatus for uniformly wetting a curvilinear surface of a length of tubing, the apparatus comprising:

a porous wetting element including a curvilinear portion having a shape complemental to the shape of the surface to be wetted, said portion being sufficiently rigid to substantially retain its shape when placed into close-fitting contact with the surface to be wetted;

liquid supply means operative to supply a liquid to the wetting element for passage of the liquid into and through the element to wet said curvilinear portion whereby when the surface to be wetted is placed into close-fitting contact with said curvilinear portion the liquid is transferred onto said surface, wetting the same substantially uniformly, wherein the liquid supply means comprises:

a vessel to hold the liquid;

mounting means to mount the wetting element to the vessel in spaced-apart relation to the liquid; and porous means extending between the liquid and the wetting element and having a first extremity immersed in the liquid and a second extremity in close contact with the wetting element and operative to carry the liquid to the element; and pressure means to apply pressure to the liquid to urge the liquid into the porous means and thence to the wetting element, said pressure means comprising a pulse valve, means to provide compressed air to the pulse valve, and means to carry the compressed air from the pulse valve into the vessel to apply pressure to the liquid.

11. Apparatus according to claim 10 wherein the porous means comprises a sponge.

12. Apparatus according to claim 10 wherein the porous means comprises a block of porous material.

13. Apparatus according to claim 10 wherein said porous means is adapted to contact and surround a substantial portion of said wetting element to facilitate transfer of liquid to said wetting element.

14. Apparatus as defined in claim 13 wherein said porous means has an opening defined therein for receiving said wetting element in a close-fitting relationship to facilitate passage of liquid from said porous means to said wetting element.

* * * * *

UNITED STATES PATENT AND TRADEMARK OFFICE

CERTIFICATE OF CORRECTION

PATENT NO. : 4,968,379

DATED : November 6, 1990

INVENTOR(S) : Mark C. Doyle

It is certified that error appears in the above-identified patent and that said Letters Patent is hereby corrected as shown below:

In the Abstract, line 10, delete "protein" and insert -- portion --.

Signed and Sealed this

Second Day of June, 1992

*Attest:*

DOUGLAS B. COMER

*Attesting Officer*

*Acting Commissioner of Patents and Trademarks*